US005983419A

United States Patent [19]

Carroll

[11] Patent Number: 5,983,419

[45] Date of Patent: Nov. 16, 1999

[54] OUTDOOR SHOWER AND SPIGOT APPARATUS

[76] Inventor: Jon Robert Carroll, P.O. Box 798, Fort Lauderdale, Fla. 33302

[21] Appl. No.: 09/115,069

[22] Filed: Jul. 14, 1998

[51] Int. Cl.[6] ..... A47K 3/22

[52] U.S. Cl. ..... 4/615; 4/601; 239/280

[58] Field of Search ..... 4/615, 612, 596, 4/599, 601, 900, 570; 239/276, 280, 273

[56] References Cited

U.S. PATENT DOCUMENTS 3,274,619 9/1966 Rolfes ..... 4/615
3,962,733 6/1976 Parry ..... 4/615
3,982,284 9/1976 Becker ..... 4/615
4,720,878 1/1988 Viner ..... 4/615
5,365,620 11/1994 MacLeod ..... 4/615

*Primary Examiner*—David J. Walczak

[57] ABSTRACT

An outdoor shower and spigot apparatus is primarily contained within a post. A hose connector is positioned on the lower end of the post and water is supplied to a spigot and shower through a water feed pipe which is positioned within the post and connected to the hose connector. A garden hose provides water to the hose coupling and a second garden hose may be connected to the spigot. In a preferred embodiment, the post is temporarily mounted in position such that it may be easily relocated.

11 Claims, 3 Drawing Sheets

OUTDOOR SHOWER AND SPIGOT APPARATUS

BACKGROUND OF THE INVENTION

1. Field of the Invention

The present invention relates to an outdoor plumbing apparatus for use as a shower and spigot. More specifically, the shower and spigot are arranged in a vertical structure having a post-like appearance that can be connected to a common garden hose for supply of water.

2. Prior Art

The uses for an outdoor shower are many. For example, showering prior to or after using a swimming pool, spa, or sauna; showering after cutting the grass or performing other yard work; showering after running, jogging, or doing other exercise to cool down. What is needed is an apparatus that is durable, can withstand the weather, is easy to use, attractive, and requires no set up after initial installation. Most of the prior inventions use a spigot for supply of water but fail to replace the spigot, which is used by the apparatus. In the past there have been attempts to provide a means by which to shower outdoors. One such attempt is found in the "Dismantlable Evaporative Cooling Shower" of Viner U.S. Pat. No. 4,720,878. Another, for a "Portable Shower" of Belkir U.S. Pat. No. Des. 256,610. A hanging variety is shown in "Portable Shower/Spray Apparatus" of Landreth U.S. Pat. No. 4,934,001. Another "Outdoor Shower Apparatus" of MacLeod U.S. Pat. No. 5,365,620 shows a unit mounted to a building having hot and cold water. Others have enclosures for the shower area for example "Portable Enclosure Assembly" of Mazpule U.S. Pat. No. 5,331,778 and "Portable Shower" of Simpson U.S. Pat. No. 5,564,138 assigned to The Coleman Company, Inc. Further, some have reservoirs as in the "Portable Shower" of Hildebrand U.S. Pat. No. Des. 339,860 and "Solar Shower" of Clark U.S. Pat. No. 5,507,275 assigned to Solar Shower Partnership. There have even been showers of sorts for the specific use of children as in the "Lawn Water Shower" of Kessler U.S. Pat. No. 5,224,652 assigned to Maui Toys, Inc. and in the "Childrens Pool and Shower" of Warren U.S. Pat. No. Des. 316,737. The common beach or pool shower being permanently attached to a source of water would also be examples of previous outdoor showers.

No apparatus is known, however, for providing a means to shower outdoors using a post-like structure with plumbing therein, fixed directly to the ground which can be selectively moveable or permanent and which attaches to the common garden hose for supply of water. Nor, is there believed to be such an apparatus which allows another common garden hose to be affixed to a spigot on the same post-like structure to be used for any number of other uses, thereby creating a new location of choice for a spigot at the same time.

SUMMARY OF THE INVENTION

The principal object of the present invention is to provide an apparatus for use as an outdoor shower and spigot primarily contained within a post-like structure which can be easily attached to a common garden hose.

It is also the object of the present invention to provide such an apparatus, which is constructed of durable, attractive, maintenance free materials.

Another object is to provide such an apparatus in an easily installable form so as to allow even the most novice person to accomplish its installation with a minimum of effort.

A further object is to provide such an apparatus which, in use, will increase the cleanliness and enjoyment of both the outdoor and indoor area in proximity to the invention.

The foregoing objects can be accomplished by providing an outdoor shower and spigot apparatus having a showerhead, control valve, hose spigot, hose coupling, and connective piping and fittings. All of the aforementioned are to be enclosed in a hollow post-like structure to provide an attractive housing and mounting for these other components. In the preferred embodiment of the invention, the hollow post is made of polyvinyl chloride (PVC) or other rigid weatherproof material a post cap is affixed to the upper extremity of the post so as to keep foreign matter from entering and to give the post a finished appearance. The piping, fittings, and valves are arranged so the only parts visible from outside the post when installed are the valves, two fittings at the shower head location, and the coupling to which the common garden hose can be attached.

DETAILED DESCRIPTION

Figure 1:
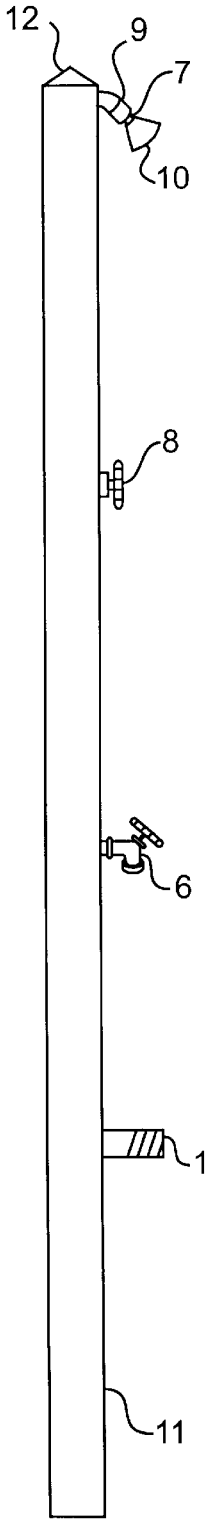
FIG. 1 is a side elevation of an outdoor shower and spigot apparatus in accordance with the present invention.
Figure 2:
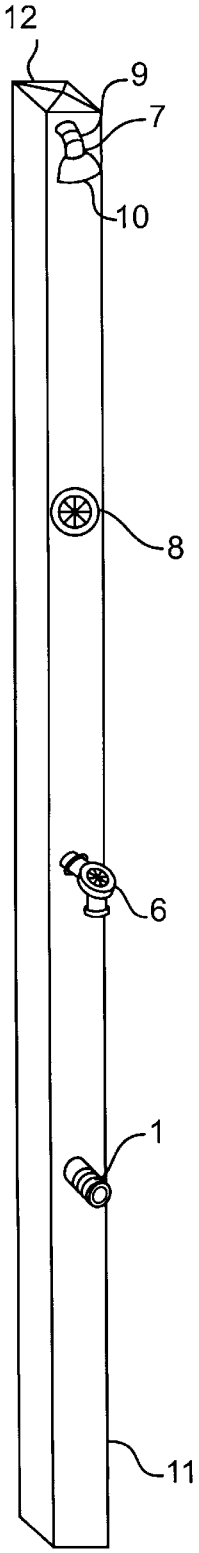
FIG. 2 is a front perspective of the apparatus in FIG. 1.

The accompanying drawings represent the preferred embodiment of an outdoor shower and spigot apparatus in accordance with the present invention, which as shown in FIG. 1 and FIG. 2, includes a rigid post 11 of square shape measuring about eight feet (2.4 meters) in length and about three and on half inches (8.75 centimeters) in width. Although, any polygonal or circular extrusion (shown as post 22 in FIG. 5) of similar size would also function. The said post or column is hollow on the inside so as to allow piping, fittings and a valve body to be positioned out of sight. A cap 12 protects the inside of the post from entry of rain or debris from the top. The post 11 is inserted into a hole dug in the ground to anchor the post in a vertical position. The hole can be filled with concrete if desired for a more permanent installation or re-filled with the dirt from the hole making the post more moveable.

Figure 3:
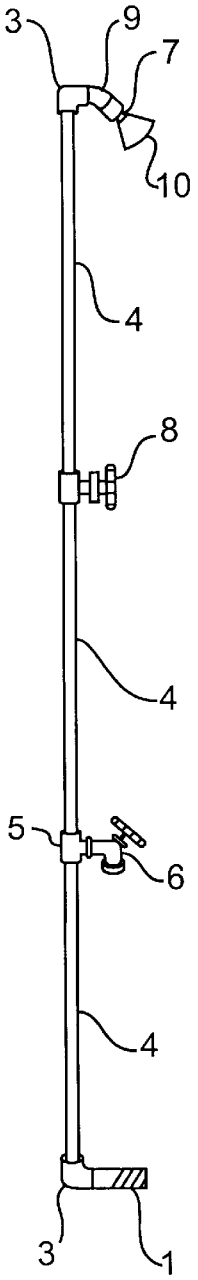
FIG. 3 is a side elevation as in FIG. 1 with the housing broken away.
Figure 4:
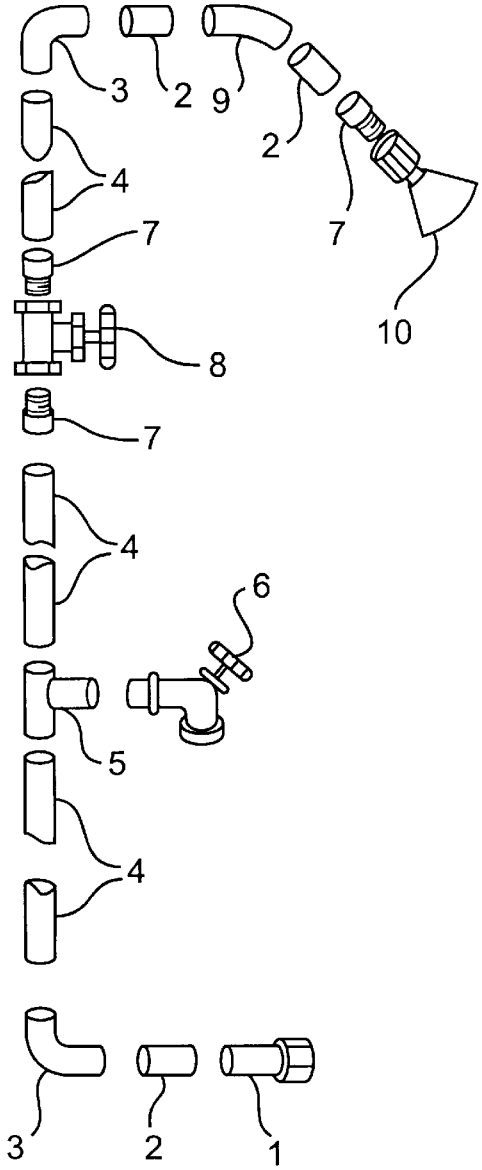
FIG. 4 is an enlarged, fragmentary, side view of such apparatus with hosing absent.

The portion of the apparatus, which carries the water, is shown assembled in FIG. 3. FIG. 4 shows each of the individual pieces which when combined create the object shown in FIG. 3 beginning with a hose coupling 1, suitable for receiving a common garden hose, which is attached using cement suitable for bonding the material of the pipe, fittings, post 11, and cap 12, preferably PVC (polyvinyl chloride), to a short section of pipe 2 approximately one and one half inches (3.75 centimeters) in length. The short section of pipe 2 is then connected to a ninety degree elbow 3 followed by a section of pipe 4 approximately two feet (60 centimeters) in length. A tee 5 having threads on the middle of the three openings is then connected to the as yet unused end of the pipe 4 and on the far end connected to another pipe 4 of about two feet (60 centimeters) in length. The far end of this pipe 4 is connected with cement to a male adapter 7 so it can be threaded into shut off valve 8 using an appropriate sealer on the threads so as to prevent any leaks.

Another male adapter 7 is connected to the other end of the shut off valve 8 using the same means as before. This male adapter 7 is then cemented to the third approximately two foot (60 centimeter) long pipe 4, the opposite end of which is cemented to a second ninety degree elbow 3. Following the ninety-degree elbow 3 is a second short section of pipe 2 of about one and one half inches (3.75 centimeters) in length. This short pipe 2 is then cemented to a forty-five degree elbow 9 from which a third short piece of pipe 2 is again cemented. From the third short piece of pipe 2 there is to be cemented a third male adapter 7 to which a showerhead 10 of any variety can be attached using the threads of the male adapter 7. Hose spigot 6 with male threads is fitted into the threaded part of tee 5. The apparatus is assembled in segments so as to allow the majority of the piping and fittings and the shut off valve body to be enclosed in the post. Holes must be drilled in the positions where there are protrusions from the post. A seven-eighths of an inch (2.1875) centimeter hole must be drilled where the short pipes 2 are to come through the post 11 at the hose coupling 1 and forty-five degree elbow 9 locations as well as where the tee 5 is to meet the spigot 6. A hole with a diameter of one and on-eighth inches (2.8125 centimeters) is to be drilled at the location of the shut off valve 8. The shut off vale 8 must be of a variety which will allow portions to be removed to facilitate part of the valve being within the post 11 and part of it being on the exterior. The final phase is to attach cap 12 to post 11 using cement yielding an outdoor shower and hose spigot apparatus.

The probable uses include but are not limited to showering before or after use of a pool, sauna, or spa; showering after doing yard work such as cutting grass; showering after running or exercising, etc. The hose spigot uses include but are not limited to an outlet for connecting a garden hose or other object, which would commonly be attached a spigot as located on most buildings and homes. The invention which in the preferred embodiment is a post like structure which can be selectively permanent or semi-permanent (i.e. moveable) by inserting the lower end of the post into a hole made in the ground and refilled either by the composition of the ground (i.e. dirt, sand, gravel, etc.) making it semi-permanent or alternatively filled with cement making it rather permanent. Further, the garden hose being connected to the apparatus providing the supply of water can be selectively above or below the ground. Alternatively, a weighted base could be substituted for the portion of the vertical member being placed in the ground as shown as base 24 in FIG. 5. Another option for removable installation would be an elongated section shown as sleeve 30 in the ground G in FIG. 6 having the same shape as the vertical member but being slightly larger so as to accommodate the vertical member within it while providing a snug, sleeve-like fit allowing a section of approximately two feet (60 centimeters) to be positioned in the ground in a primarily permanent manner allowing the post-like vertical member to be inserted and removed many times over. Either of these latter methods could prove to be very useful in climates where temperatures fall below freezing, allowing the structure to be stored in a less susceptible location.

The invention operates as a typical hose spigot would at the lower portion of the apparatus. The upper portion of the apparatus operates as a shower with a single handle to control the amount of water exiting the showerhead. Both the shower and the spigot use the water provided by a common garden hose at whatever the temperature of the water may be which depends on a number of factors including the length of the garden hose and the weather on any given day. It is believed the invention as stated will withstand temperatures below freezing provided that the apparatus is disconnected from the water supply, drained of water and the valves are in the open position.

Figure 5:
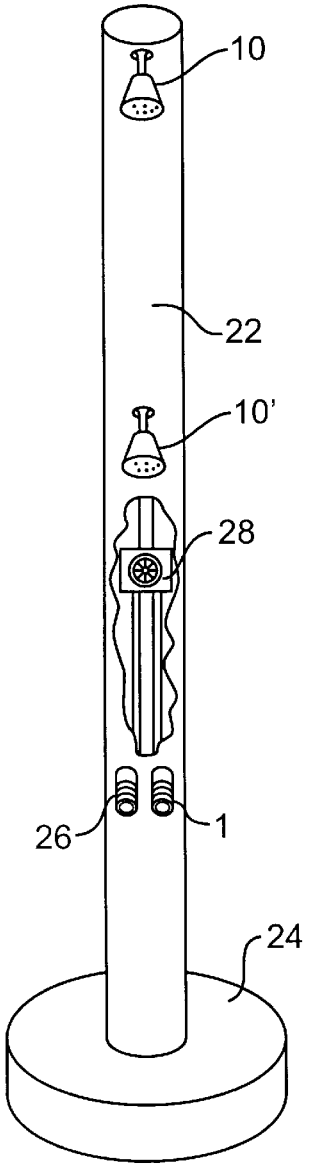
FIG. 5 is a partially cut-away view of another embodiment of the invention.
Figure 6:
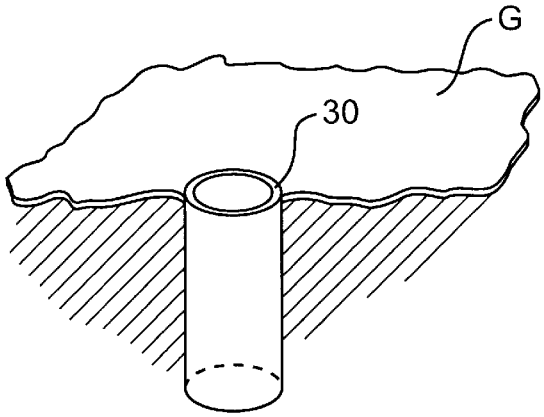
FIG. 6 shows one method of mounting the shower and spigot apparatus.
Figure 7:
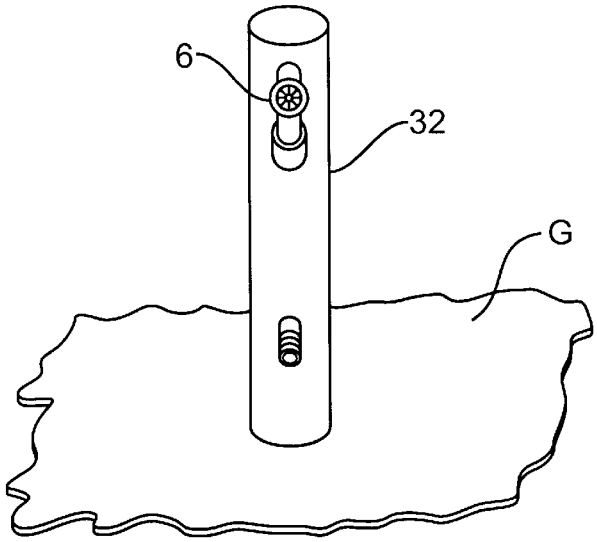
FIG. 7 is another embodiment of the invention.

Some of the potential alternatives to the preferred embodiment of the present invention include but are not limited to the apparatus having a shower as described but having no spigot. The apparatus could also be modified to have no shower or shower valve but rather just a spigot on a post possibly of lesser length, as shown in FIG. 7, as post 32 mounted in the ground G, with hose coupling 1, and spigot 6. Pipes and fittings described above are of the on-half inch (1.25 centimeter) variety but could be of any reasonable size. The valves and showerhead can even in the preferred embodiment be of any suitable material given their threaded connections. A means for rinsing the lower portion of the human anatomy comprising a second showerhead or other spray device could be added, for example, as shown in FIG. 5 as shower head 10'. The temperature of the water exiting the device could be varied if hot water is provided to the apparatus and a mixing valve is utilized as shown in FIG. 5 where hot water is provided through hose coupling 26, cold water is provided through hose coupling 1, and the water is mixed in mixing valve 28, shown through the cut-away portion of post 22. Further, any of the components discussed could take alternative positions on the post-like member of the apparatus.

The foregoing description of the preferred embodiment of the invention has been presented for the purpose of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

I claim:

1. An outdoor shower and spigot apparatus comprising:

an elongated post having a lower end and an upper end and positioned substantially vertically;

a cap affixed to the upper end of said post for restricting the flow of water or debris into the upper end of said post; and a piping system for carrying water to the upper end of said post, said piping system comprising:

a hose connector for receiving a connecting end of a garden hose;

a water feed pipe positioned within said post, said water feed pipe being operably connected to said hose connector for carrying water from said garden hose;

a spigot operably connected to said water feed pipe;

a shower head operably connected to said water feed pipe; and a valve having a handle, said valve being operably connected to said water feed pipe between said hose connector and said shower head for controlling the amount of water flowing to said shower head;

wherein said hose connector, said spigot, said handle and said shower head are positioned exterior to said post.

2. An outdoor shower and spigot apparatus as in claim 1, further comprising a sleeve mounted in the ground for slidingly receiving said lower end of said post and for maintaining said post in a substantially vertical position.

3. An outdoor shower and spigot apparatus as in claim 1, further comprising a weighted base attached to said lower end of said post for maintaining said post in a substantially vertical position.

4. An outdoor shower and spigot apparatus as in claim 1, wherein said post is polygonal in cross-sectional shape.

5. An outdoor shower and spigot apparatus as in claim 1, wherein said post is circular in cross-sectional shape.

6. An outdoor shower and spigot apparatus as in claim 1, wherein said hose connector supplies cold water received from said garden hose, said apparatus further comprising a second hose connector for receiving a connecting end of a second garden hose for supplying hot water received from said second garden hose to said water feed pipe.

7. An outdoor shower and spigot apparatus as in claim 6, wherein said valve comprises a mixing valve for controlling the temperature of the water flowing to said shower head.

8. An outdoor shower and spigot apparatus as in claim 1, further comprising a second shower head operably connected to said water feed pipe between said hose connector and said shower head.

9. An outdoor spigot apparatus comprising:

a post having a lower end and an upper end and positioned substantially vertically;

a cap affixed to the upper end of said post for restricting the flow of water or debris into the upper end of said post; and a piping system for carrying water to the upper end of said post, said piping system comprising:

a hose connector for receiving a connecting end of a garden hose;

a water feed pipe positioned within said post, said water feed pipe being operably connected to said hose connector for carrying water from said garden hose; and a spigot operably connected to said water feed pipe wherein said hose connector and said spigot are positioned exterior to said post.

10. An spigot apparatus as in claim 9, further comprising a sleeve mounted in the ground for slidingly receiving said lower end of said post and for maintaining said post in a substantially vertical position.

11. An outdoor spigot apparatus as in claim 9, further comprising a weighted base attached to said lower end of said post for maintaining said post in a substantially vertical position.

* * * * *